US007308767B2

(12) United States Patent
Soriano et al.

(10) Patent No.: US 7,308,767 B2
(45) Date of Patent: Dec. 18, 2007

(54) PERFECTED DEVICE FOR WALKING ON SNOW OR ICE

(76) Inventors: Antonio Cutando Soriano, Jardines, 4, 18100 Armilla, Granada (ES); Antonio Del Castillo Lopez, Jardines, 4, 18100 Armilla, Granada (ES)

( * ) Notice: Subject to any disclaimer, the term of this patent is extended or adjusted under 35 U.S.C. 154(b) by 954 days.

(21) Appl. No.: 10/741,845

(22) Filed: Dec. 19, 2003

(65) Prior Publication Data

US 2004/0148802 A1 Aug. 5, 2004

(30) Foreign Application Priority Data

Jan. 23, 2003 (ES) ..... 200300160

(51) Int. Cl.
*A43C 15/06* (2006.01)

(52) U.S. Cl. ..... 36/125; 36/122

(58) Field of Classification Search ..... 36/122, 36/124, 125, 7.6, 66; 280/604
See application file for complete search history.

(56) References Cited

U.S. PATENT DOCUMENTS

| | | | | |
|---|---|---|---|---|
| 5,901,471 | A * | 5/1999 | Warner | 36/124 |
| 6,178,666 | B1 * | 1/2001 | Kiniry et al. | 36/125 |
| 6,684,534 | B2 * | 2/2004 | Dodge | 36/122 |
| 2001/0010130 | A1 * | 8/2001 | Lancon | 36/122 |
| 2002/0104234 | A1 * | 8/2002 | Lancon et al. | 36/122 |
| 2003/0101623 | A1 * | 6/2003 | Settelmayer | 36/124 |

* cited by examiner

*Primary Examiner*—Jila M Mohandesi
(74) *Attorney, Agent, or Firm*—Davidson, Davidson & Kappel, LLC

(57) ABSTRACT

A perfected device for walking on snow or ice consisting of platforms (1) that are fitted on the upper face of the rackets (20) and have a swivel mechanism (6) formed by a spherical or similar piece equipped with axles (22) at the heel end. At the bottom of the platforms (1), they also have housings (24), spikes (8), rackets (20) and, at the heel end, semi-cylindrical parts (23) and (23') equipped with fastening elements (10) and (10').

3 Claims, 4 Drawing Sheets

PERFECTED DEVICE FOR WALKING ON SNOW OR ICE

FIELD OF THE INVENTION

This invention is for use in industries manufacturing appliances, devices and accessories for the practice of mountain climbing, trekking or skiing.

This invention is for use in industries manufacturing appliances, devices and accessories for the practice of mountain climbing, trekking or skiing.

BACKGROUND

The applicant is aware of the existence at the present time of a large number of models of racket-type snowshoes that make it easier for mountaineers to move across snow-covered surfaces. These racket-type snowshoes only allow for forward and backward movement and are therefore suitable for moving across flat surfaces, but are not suitable for negotiating slopes.

The applicant is also aware of the existence at the present time of a large number of elements known as "crampons" that are attached to the surface of the user's boots when their use is required for moving over ice.

However, the applicant is not aware of the existence at the present time of an invention capable of being employed by a mountaineer using mountain boots or skis, with the means for regulating the length, that can be used like a racket-type snowshoe on which a platform is mounted that is attached to the boot, both parts having protruding elements that give them the shape of crampons while at the same time the parts can be separated from each other by simply applying pressure and also have lateral articulation which prevents injury to the ankle ligaments.

SUMMARY OF THE INVENTION

The present invention relates to a perfected device for walking on snow or ice that provides better adaptability of the user's foot when practicing mountain climbing in which the user goes over different types of surface such as snow, ice, mud, etc. It incorporates at the bottom a device similar to the well-known "crampons", which avoids the mountaineer having to carry greater weight in his or her equipment, as it has a swivel element in its structure that helps the climber to walk on slopes on which there is risk of injury to the ankle ligaments, since slopes should be negotiated sideways and not crossed in a straight line.

The perfected device for walking on snow or ice that the invention proposes constitutes in and of itself an obvious novelty within its field of application, as it substantially reduces the weight the user has to carry, since it removes the hitherto absolute need to have crampons available when climbing mountains.

More specifically, the perfected device for walking on snow or ice which is the object of the invention consists of a pair of rackets made of high-strength, lightweight plastic equipped with the means for attaching two platforms to them which are in turn attached to the surface of the climber's footwear, for which both the rackets and the platforms have appliances enabling them to be joined to each other and in turn enabling them to be fastened onto the user's foot.

The rackets have vertical protrusions on the underneath in the form of spikes suitably screwed onto the structure of the platforms with appropriately moulded areas providing for the attachment of an articulating element facilitating lateral movement of the user's foot when walking on slopes which, as is well known, must be negotiated sideways and not head on.

To sum up, the invention consists of two racket-type snowshoes, provided with perforations for incorporating the corresponding spikes, and two attachment platforms for the ski boots or mountain boots, with bolts for attaching the accessories and the corresponding accessory or element suitable for the swivelling of the ankle and the accessory for replacing the crampons, having an adjustment screw as a safety element to ensure that the piece separating the racket from the platform does not give way in the event of a knock.

To walk on non-slippery surfaces, the invention is used by attaching the above-mentioned platforms to the surface of the racket. The platforms incorporate an axle with a ball or sphere providing the user with the possibility of moving his or her ankle in a tried and tested angle of oscillation of between 5% and 10%. This lateral swivel is made possible by the above-mentioned spherical piece with an axle running through it.

To walk on ice or on slippery surfaces requiring the use of crampons, this device has spikes on the platform whose function is to grip the surface in a similar way to crampons, preventing the climber from slipping. When the climber wishes to do without the racket, he or she can remove the platform with the spikes for moving across frozen surfaces by simply applying pressure to it. However, it should be pointed out that the swivel function is not available in this application, as this function is only available when the two pieces making up the device are joined together, i.e., when the platform is attached to the racket.

BRIEF DESCRIPTION OF THE DRAWINGS

To complement this description and in order to make it easier to understand the characteristics of this invention, this descriptive report is accompanied, as an integral part thereof, by a set of plans in which, by way of illustration and not by way of limitation, the following has been represented.

DETAILED DESCRIPTION OF THE PREFERRED EMBODIMENTS

Figure 1:
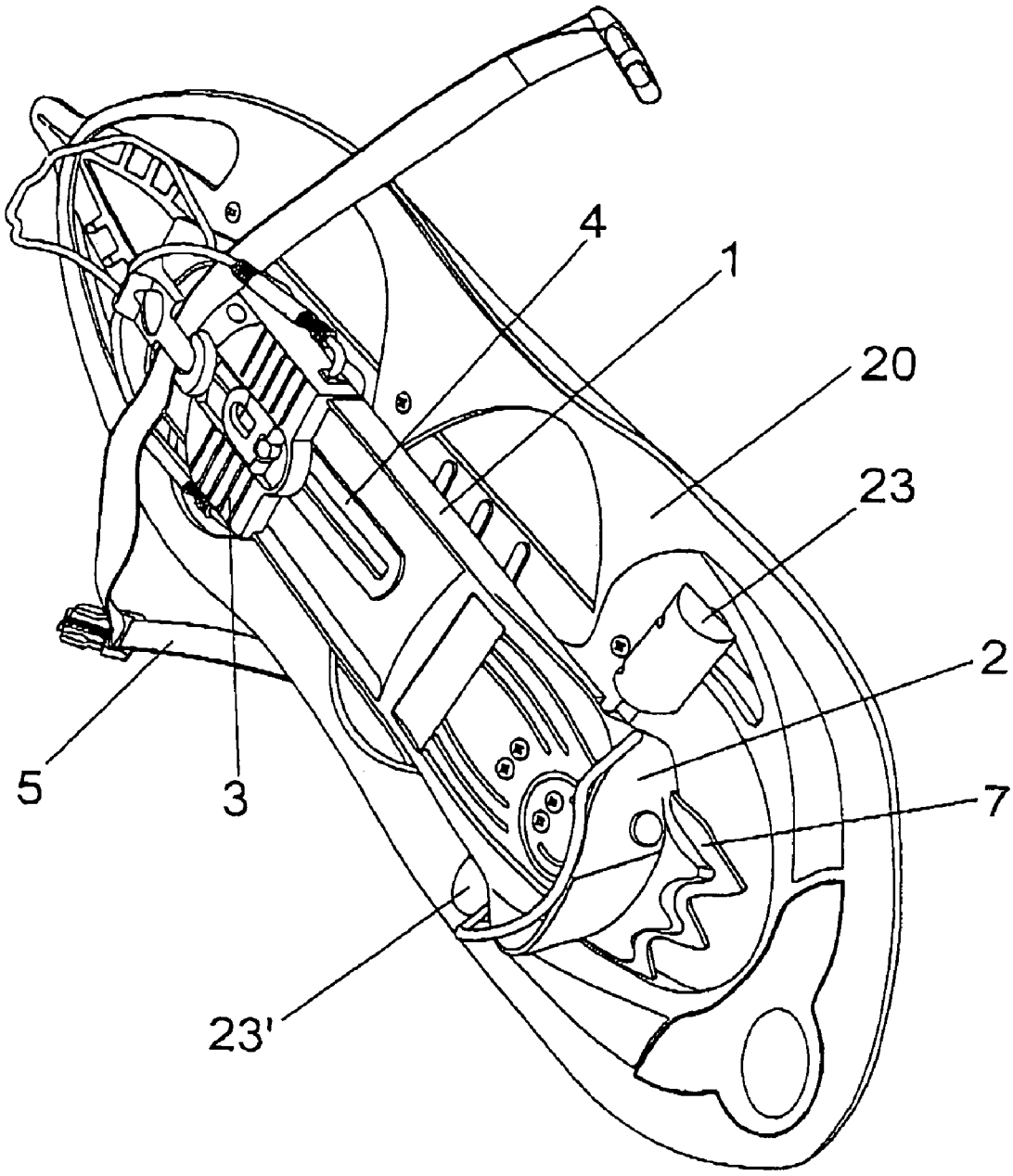
FIG. 1. This is a perspective view of the object of the invention of a perfected device for walking on snow or ice. In this graphic representation it is possible to appreciate the two parts that make up the device joined together, as seen from above.
Figure 2:
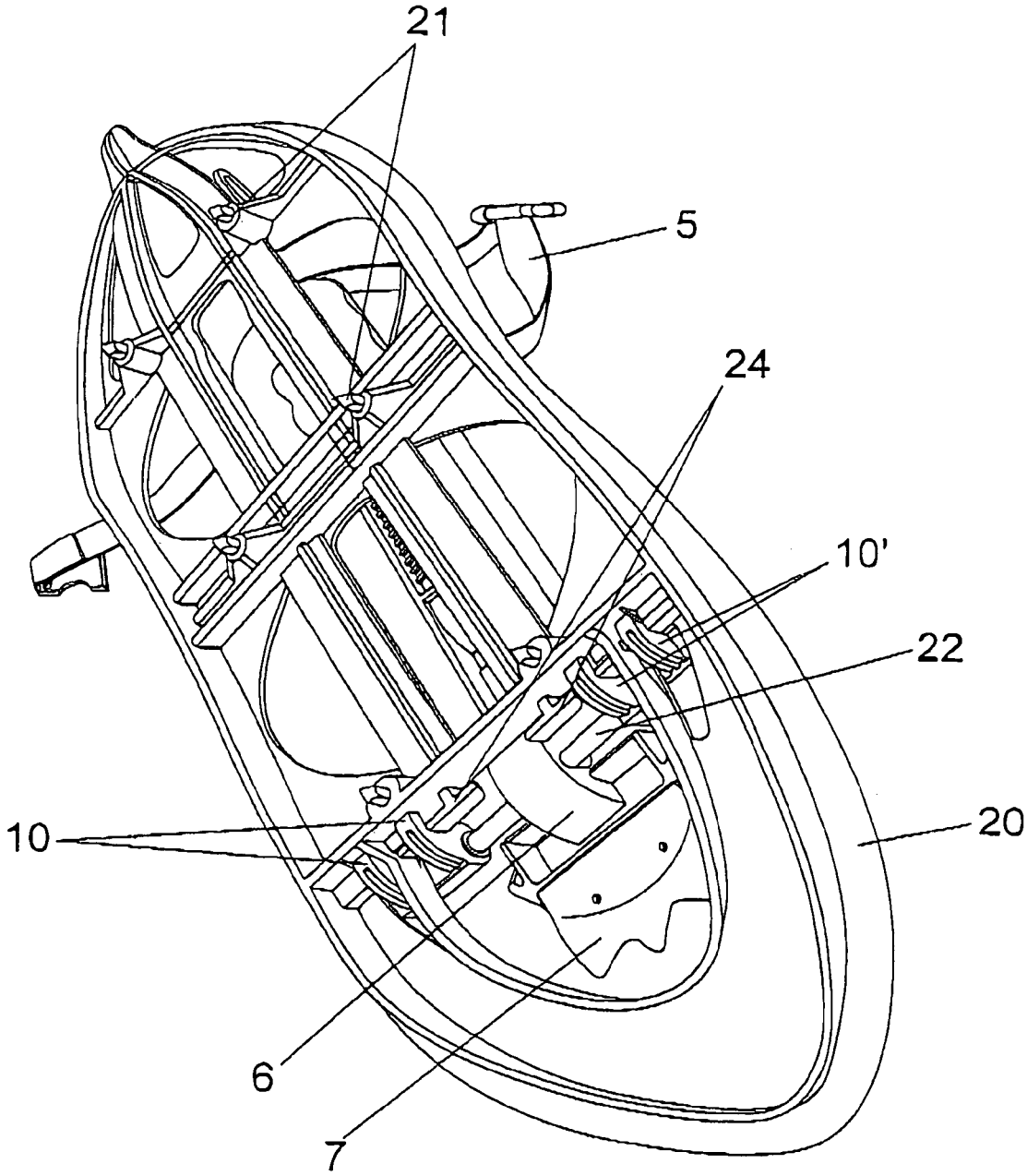
FIG. 2. This shows a view of the object represented in FIG. 1 similarly in perspective, but here seen from below. In this graphic representation it is possible to appreciate the protrusions or spikes sticking out from the part constituting the racket and the swivel mechanism coming out of the platform that is attached to the bottom of the racket structure.
Figure 3:
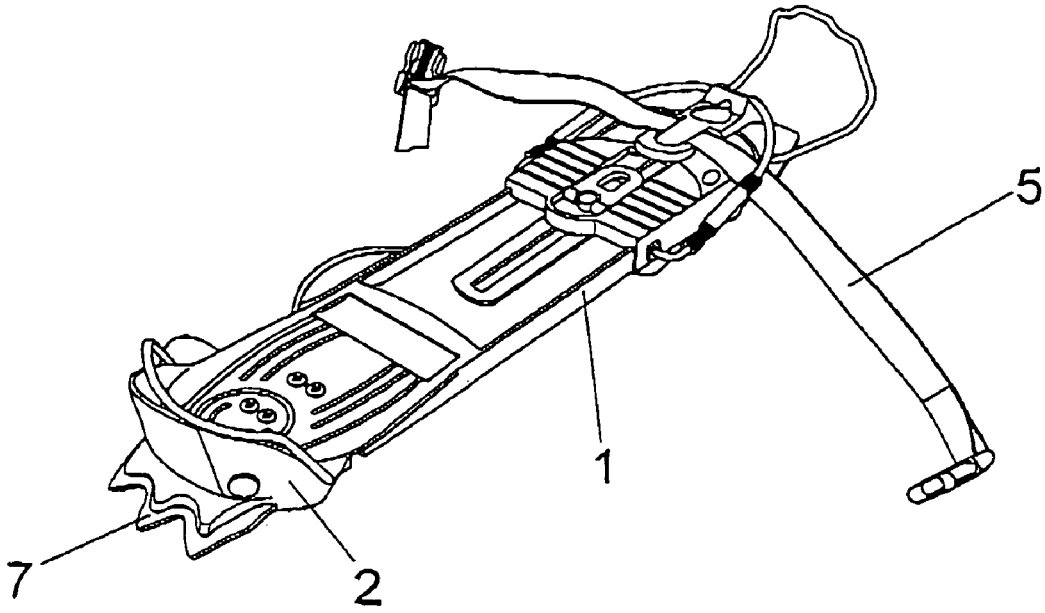
FIG. 3. This is a perspective view of the part constituting the platform as seen from above.
Figure 4:
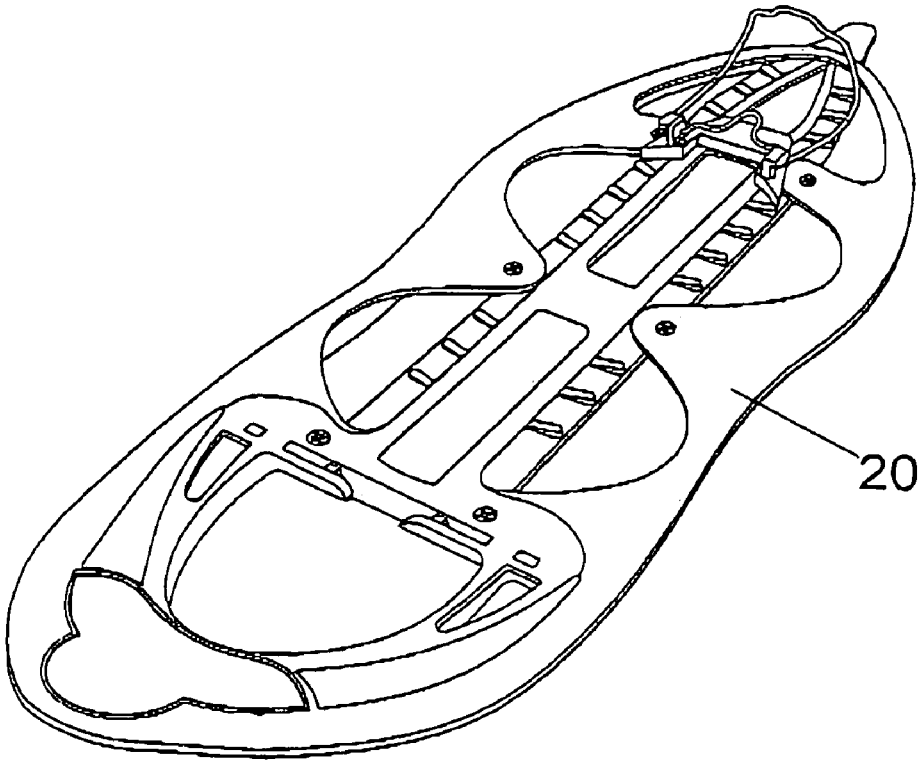
FIG. 4. This represents the racket as seen from above.

Following these figures, it can be seen that the perfected device for walking on snow or ice consists of an upper part (1) that fits onto a racket (20). Both parts are made of extremely strong, lightweight plastic with various metal elements enabling the boot to be fastened onto the platform and the platform onto the racket. They also have straps made of extremely strong textile material constituting the harness for securing the user's boots to the platform.

Obviously, in this invention consideration should be given to the existence of two pieces constituting rackets that are logically applicable to each of the climber's feet.

The part (1) has a longitudinal groove (4) along which a supporting element (3) can be moved in order to adjust the device to the length of the user's foot. This element has a heel (2) at the rear with a sharp projection (7) under which the swivel mechanism is attached. This mechanism is formed by a spherical or similar-shaped part (6) with an axle (22) running through it with attachment appliances at either end (10) and (10') that fit and are fixed onto ledges (24) on the racket (20).

The racket (20) has spikes or projections (21) that help the mountaineer to walk.

The textile or similar materials of the elements for attaching or fastening the user's boot onto the platform (1) are indicated by the number (5).

The platforms (1) are equipped with articulated metal devices for attaching them to the boot, and the racket (20), in turn, also has an element for attaching it to the platform.

Figure 5:
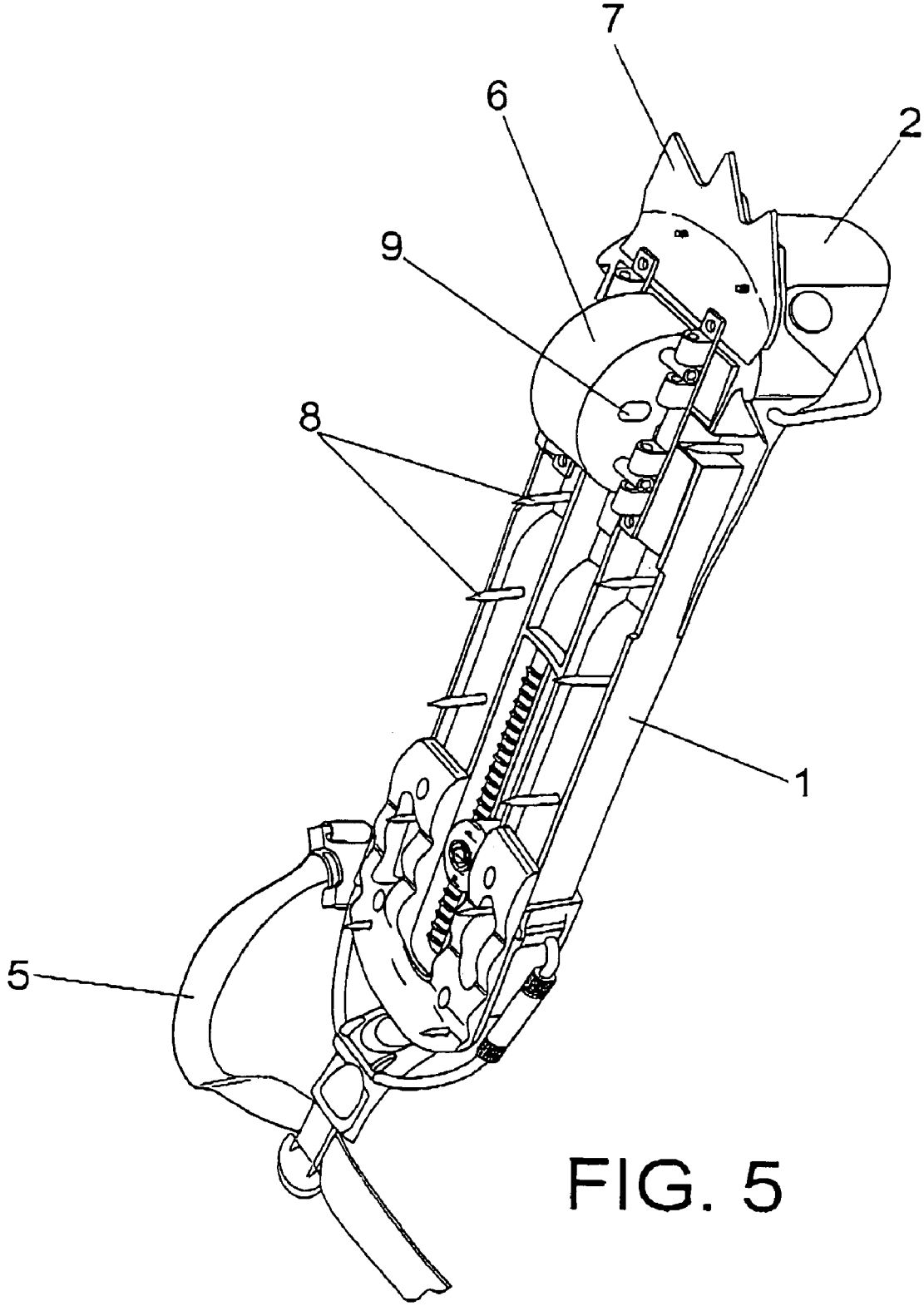
FIG. 5. This is a perspective view of the platform as seen from below.

The platform, as can be seen in FIG. 5, has spikes (8) that help to shape the platforms like crampons when the platform (1) is separated from the racket (20). In this Figure it is also possible to see the existence of the swivel part (6) which has a hole in the middle (9) into which the ends of the piece (22), which acts as a securing element facilitating movement, are introduced or inserted.

The swivel mechanism is situated in correspondence with the bottom of the platform (1) where the mechanism formed by the body (6) with a hole (9) in the side is located.

The swivel mechanism has two semi-spherical bodies (23) and (23') on either side of the heel area of the platform that secure the mechanism to the top of the racket.

The invention claimed is:

1. A device for walking on snow or ice comprising a platform fitted on top of a racket, the platform having a heel end and a toe end, the platform having a swivel mechanism on a bottom side of the heel end, the swivel mechansim having a hole formed therethrough into which an axle is fitted, each end of the axle secured to the platform via a housing on the bottom of the platform, the platform and the racket each having spikes protruding vertically from the bottom thereof.

2. The device according to claim 1, wherein the swivel mechanism is cylindrical in shape.

3. The device according to claim 1, wherein each end of the axle includes a fastening element for securing the axle to the housing, each fastening element formed in a bottom of a semi-circular piece which protrudes laterally from a corresponding lateral side of the platform, the position of the semi-circular pieces corresponding to a location on the device where a heel of a user would rest when the device is in use.

* * * * *